United States Patent [19]

Watts, Jr.

[11] Patent Number: 4,464,665

[45] Date of Patent: Aug. 7, 1984

[54] SLOTTED CABLE ANTENNA STRUCTURE

[76] Inventor: Chester B. Watts, Jr., 6505 Pinecrest Ct., Annandale, Va. 22003

[21] Appl. No.: 348,240

[22] Filed: Feb. 12, 1982

[51] Int. Cl.[3] ..... H01Q 13/10

[52] U.S. Cl. ..... 343/769; 343/771

[58] Field of Search ..... 343/767–771, 343/789, 850, 844, 853; 333/234, 229

[56] References Cited

U.S. PATENT DOCUMENTS 4,129,841 12/1978 Hildebrand et al. ..... 343/771

4,197,541 4/1980 Nemit et al. ..... 343/771

FOREIGN PATENT DOCUMENTS 1259417 1/1968 Fed. Rep. of Germany ..... 333/234

*Primary Examiner*—Eli Lieberman

*Assistant Examiner*—Michael C. Wimer

[57] ABSTRACT

This invention relates to the structure of slotted cable antennas used in end-fire glide slope systems employed in the instrument landing of airplanes. The structure is an improvement over that described in my U.S. Pat. No. 3,699,582 titled Slotted Cable Glide Slope Antenna. An air-dielectric coaxial transmission line, carrying a travelling wave of radio frequency energy, has a number of probe-fed slots along the outer conductor which leak current onto the outside surface of the line, resulting in radiation. The magnitude of the radiation from each slot is controlled by the probe coupling to the inner conductor and by a slot shunt consisting of a coaxial shorted line section. The relative phase of the radiations from adjacent slots is controlled by the electrical spacing of the slots. The electrical spacing increases with rising temperature due to the expansion coefficient of the transmission line, but this effect is compensated by the inclusion within the transmission line of a strand of polyethylene or similar dielectric having a negative temperature coefficient.

3 Claims, 4 Drawing Figures section a-a

SLOTTED CABLE ANTENNA STRUCTURE

SUMMARY

It is an object of this invention to provide a slotted cable antenna structure having improved mechanical and electrical stability, but which is relatively simple and inexpensive to manufacture. This has been accomplished through a particular arrangement of parts, some of which are similar to common copper plumbing fittings, together with other special parts, to be described, including a strand of polyethylene providing negative temperature compensation to cancel out the positive thermal coefficient of the transmission line.

LIST OF FIGURES

DESCRIPTION

Figure 1:
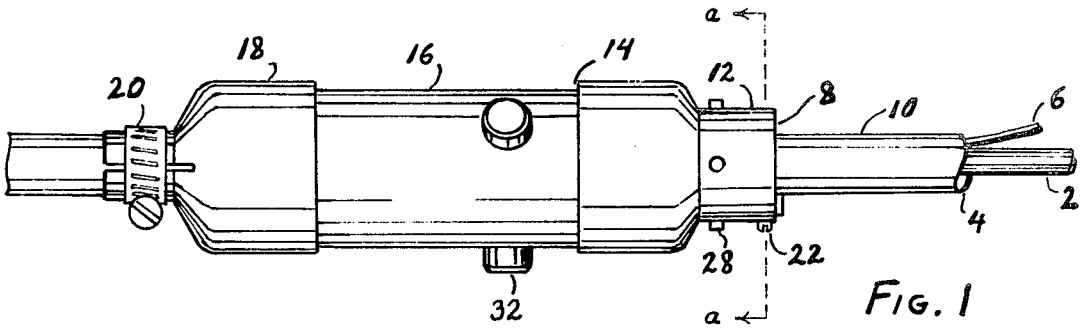
FIG. 1 is an external view of an embodiment of the antenna slot structure.

A external view of a preferred embodiment of the antenna slot structure is shown in FIG. 1. The main transmission line, carrying inside a travelling wave of rf energy, and having mostly an air dielectric, has an inner conductor 2, and an outer conductor 4. A relatively thin strand 6 of insulating material such as polyethylene, having a large negative temperature coefficient of dielectric constant, is included between the inner and outer conductors. The slot 8 is formed between the outer surface 10 of outer conductor 4 and the metal slot piece 12 which is a part of shunt assembly 14. Other parts of the shunt assembly 14, which are conductively connected to each other, include metal shunt tube 16, metal shunt short 18, clamp 20, and probe screw 22. Probe screw 22 is capacitively coupled to inner conductor 2 causing some rf voltage to appear across the slot 8, which in turn causes antenna current to flow on the outside surface 10, resulting in radiation.

Figure 2:
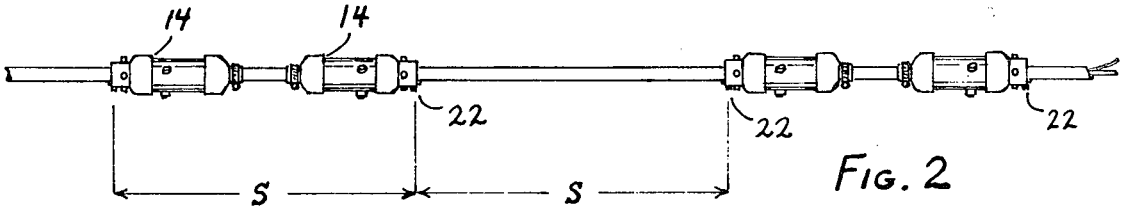
FIG. 2 is an external view of a section of slotted cable antenna showing several of the slot structures spaced along the length of the transmission line.

In practice, a large number of these slot shunt assemblies 14 are spaced along the transmission line as in FIG. 2, forming, in effect, an array of radiating subassemblies. The relative phase of the radiations produced by adjacent slots is controlled by the phase velocity of the travelling wave within the transmission line, and by the slot spacing S. If the spacing S is in the neighborhood of half wavelength, the relative phase would be about 180 degrees, but by turning alternate assemblies end-for-end, as shown in FIG. 2, adjacent radiations are made to be nearly in phase, resulting in approximately broadside reinforcement.

Figure 3:
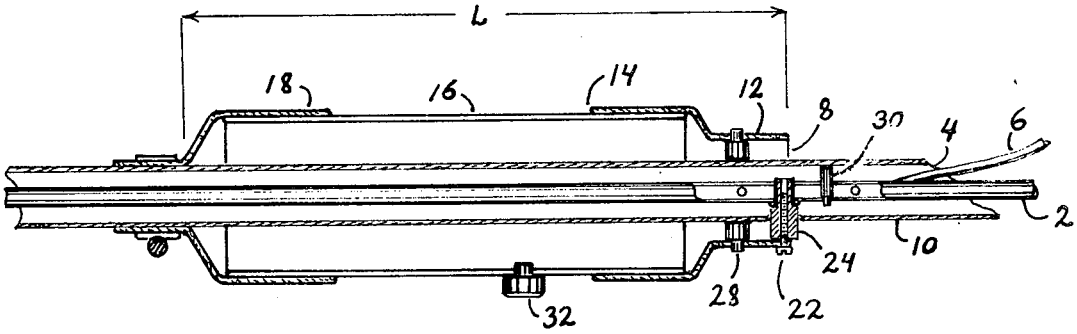
FIG. 3 is a longitudinal sectional view of the slot structure shown in FIG. 1.

The details of the structure may be made more clear by means of FIG. 3 which shows a longitudinal sectional view. Probe screw 22 is surrounded by a teflon insulating sleeve 24 with the purpose of preventing any possibility of the probe making contact with either the outer conductor 4, or the inner conductor 2. A metallic eyelet 26 is soldered in a hole in the inner conductor 2, and the probe screw 22 extends somewhat into the eyelet producing capacitive coupling which is easily controlled by the length of the screw. A voltage thus is produced across the slot 8. However, the magnitude of this voltage, hence the radiation, is also controlled by the impedance in shunt with the slot, namely, that produced by the shunt assembly 14. The shunt impedance is characterized by the behavior of a short-circuited transmission line section. If the length L is very short, the shunt impedance is very low, and not much radiation can occur. If the length L approaches quarter wavelength, the shunt impedance becomes high, and much more radiation will occur. Thus, in manufacture, the length of the shunt tube 16 is used to control the shunt impedance. The clamp 20 can be eliminated if desired by soldering the shorting piece 18 directly to the outer conductor 4. Electrical and mechanical stability in this assembly is maintained by the insertion of three close fitting teflon spacers 28 which serve to hold a constant width of slot 8. Support of the main transmission line inner conductor 2 is by means of the probe sleeve 24, in conjunction with teflon pins 30 spaced radially around the conductor.

Figure 4:
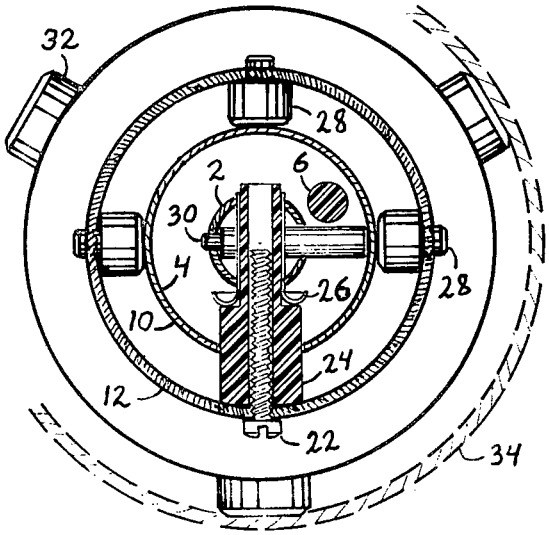
FIG. 4 is a transverse cross-sectional view of the slot structure shown in FIG. 1 and FIG. 3.

FIG. 4 is a transverse section through the structure to help perhaps clarify the arrangement and function of the parts already discussed. The temperature compensation strand 6 is visible in this view. Its diameter is chosen according to the amount of negative compensation desired. If the compensation is exact, then even though the physical spacing S increases with temperature, the transmission line phase velocity will increase by just enough to keep the relative radiated phases constant. The location of the strand 6 within the transmission line cross-section is not critical electrically. Strand 6 is not used for mechanical support. A part not previously mentioned is a spacer 32, of non-conductive material, providing support for a weather protective cylindrical dielectric cover 34 installed concentrically over the entire antenna.

I claim:

1. A slotted cable antenna structure comprising a coaxial transmission line having an inner conductor and an outer conductor, a slot formed between the outer surface of said outer conductor and a shunt conductor coaxially surrounding a portion of said outer conductor, said shunt conductor being connected at one end to said outer conductor, a probe screw at the opposite end of said shunt conductor, said probe screw conductively connected to said shunt conductor, said probe screw projecting through said outer conductor without conductive connection, said probe screw capacitively coupled to said inner conductor, and finally, a strand of insulating material having a negative temperature coefficient of dielectric constant, said strand running the length of said transmission line in the space between the inner and outer conductors, said strand being sized to compensate wholly or partially for the positive thermal expansion coefficient of said transmission line.

2. A structure as in claim 1, wherein said shunt conductor comprises a plurality of telescoping tubular pieces having sliding or clamping contact providing for changing the effective length of said shunt conductor, thereby controlling the magnitude of the radiation.

3. A structure as in claim 1, wherein a multiplicity of said shunt conductors together with their associated probe screws are mounted on said transmission line, said shunt conductors being mounted in alternating reversed end-for-end orientation on said common transmission line, the spacing between successive adjacent probe screws being chosen to control the relative phase of the radiations.

* * * * *